US008315407B2

(12) United States Patent
Jeon et al.

(10) Patent No.: US 8,315,407 B2
(45) Date of Patent: Nov. 20, 2012

(54) APPARATUS AND METHOD FOR LOCALIZING SOUND SOURCE IN REAL TIME

(75) Inventors: Wook Jae Jeon, Suwon-si (KR); Seung Hun Jin, Suwon-si (KR); Dong Kyun Kim, Suwon-si (KR); Jong Suk Choi, Seoul (KR); Chang Hoon Lee, Daejeon-si (KR); Mun Sang Kim, Seoul (KR)

(73) Assignee: Sungkyunkwan University Foundation for Corporate Collaboration, Suwon-Si (KR)

( * ) Notice: Subject to any disclaimer, the term of this patent is extended or adjusted under 35 U.S.C. 154(b) by 784 days.

(21) Appl. No.: 12/497,043

(22) Filed: Jul. 2, 2009

(65) Prior Publication Data

US 2010/0111314 A1 May 6, 2010

(30) Foreign Application Priority Data

Nov. 5, 2008 (KR) ..... 10-2008-0109243

(51) Int. Cl.
*H04R 3/00* (2006.01)

(52) U.S. Cl. ..... 381/92; 700/94; 367/118

(58) Field of Classification Search ..... 700/94, 700/245; 367/118, 123–125, 127, 99; 704/238; 379/388.04; 381/92, 94.1, 94.2, 98, 313, 381/317

See application file for complete search history.

(56) References Cited

U.S. PATENT DOCUMENTS

| | | | | |
|---|---|---|---|---|
| 7,191,090 | B1 * | 3/2007 | Cunningham | 702/150 |
| 7,424,118 | B2 * | 9/2008 | Mori et al. | 381/77 |
| 8,082,051 | B2 * | 12/2011 | Mihelich et al. | 700/94 |
| 2001/0031053 | A1 * | 10/2001 | Feng et al. | 381/92 |
| 2006/0256660 | A1 | 11/2006 | Berger | |
| 2007/0233321 | A1 * | 10/2007 | Suzuki | 700/245 |
| 2008/0267413 | A1 * | 10/2008 | Faller | 381/1 |

OTHER PUBLICATIONS

Rabinkin, D. V. "Digital Hardware and Control for a Beam-Forming Microphone Array" Master's thesis, Department of Electrical Engineering, Rutgers University, New Brunswick NJ USA, Jan. 1994.

Yeom, S. S. et al. "An application system of probabilistic sound source localization" In: Control, Automation and Systems, 2008. ICCAS 2008. International Conference on. Issue Date: Oct. 14-17, 2008.

* cited by examiner

*Primary Examiner* — Xu Mei
*Assistant Examiner* — Friedrich W Fahnert
(74) *Attorney, Agent, or Firm* — Lexyoume IP Meister, PLLC.

(57) ABSTRACT

The present invention relates to an apparatus and method for localizing a sound source in real time. The apparatus for localizing a sound source in real time includes a sound signal acquisition unit for acquiring sound signals through two or more channels. A sample delay storage unit stores a plurality of pieces of data, sampled from the sound signals acquired through respective channels, for a predetermined period of time. A correlation calculation unit calculates correlations between the channels from the plurality of pieces of sampled data stored in the sample delay storage unit. A sound source direction calculation unit calculates an azimuth angle of the sound source using both the correlations between the channels and location relationships of the sound signal acquisition unit. Accordingly, the present invention can localize a sound source in real time.

12 Claims, 6 Drawing Sheets

APPARATUS AND METHOD FOR LOCALIZING SOUND SOURCE IN REAL TIME

BACKGROUND OF THE INVENTION

1. Field of the Invention

The present invention relates, in general, to an apparatus and method for localizing a sound source, and, more particularly, to a hardware structure which can localize a sound source in real time using both a buffer, employing a dual port structure, and a plurality of registers for respective channels.

2. Description of the Related Art

In general sound processing, the localization of a sound source generating sound is very important because the principal information required for the analysis of subsequently acquired sound and the detection of the contents of the sound is provided. Therefore, to achieve this localization, there has been proposed a method of arranging a plurality of microphones to exhibit uniform characteristics with respect to the direction of a sound source, and localizing the sound source using the time difference between the times at which sound from the sound source arrives at the respective microphones. Generally, such a method is accomplished by repeating step-by-step calculations, and the performance thereof has already been proven in general-purpose computers using a software-based method.

However, in order to determine a correlation between sound signals acquired from respective channels from the standpoint of the characteristics of a sound source localization method, the sound signals must be compared with each other while sound signals acquired for a predetermined period of time are moved with respect to a time coordinate axis, and such a comparison must be repeated a number of times corresponding to the number of permutations of a microphone set. Accordingly, when an existing software-based method based on sequential processing is used, a lot of calculation time is required. With regard to such a calculation time, as the length of a sound signal to be calculated is increased in order to accurately localize a sound source, the amount of calculation increases exponentially. In particular, in the case of sound source localization, the necessity thereof is emphasized as the function of an intelligent sensor in applications such as domestic robots or intelligent vehicles. However, such an excessive amount of calculation and the excessive calculation time may limit processing in the case of small-sized embedded systems, thus causing problems in actual applications.

SUMMARY OF THE INVENTION

Accordingly, the present invention has been made keeping in mind the above problems occurring in the prior art, and an object of the present invention is to provide a structure and method which can simultaneously perform comparison between respective channels by delaying/storing sound signals acquired from the respective channels without using a sequential method of processing sound signals one by one at a given time point.

In accordance with an aspect of the present invention, there is provided an apparatus for localizing a sound source in real time, comprising a sound signal acquisition unit for acquiring sound signals through two or more channels; a sample delay storage unit for storing a plurality of pieces of data, sampled from the sound signals acquired through respective channels, for a predetermined period of time; a correlation calculation unit for calculating correlations between the channels from the plurality of pieces of sampled data stored in the sample delay storage unit; and a sound source direction calculation unit for calculating an azimuth angle of the sound source using both the correlations between the channels and location relationships of the sound signal acquisition unit.

Preferably, the apparatus may further comprise a sound signal buffering unit for buffering acquired sound signals of a predetermined length; and a valid signal determination unit for determining whether the sound signals of the predetermined length buffered in the sound signal buffering unit are valid sound signals.

Preferably, the sound signal buffering unit may comprise a dual port structure in which input and output are processed through different ports. Further, the sound signal buffering unit may be implemented as a structure of a circular queue.

Preferably, the valid signal determination unit may determine that the sound signals of the predetermined length are valid sound signals when energy of the sound signals is equal to or greater than a reference value. Further, the valid signal determination unit may determine valid sound signals using a plurality of buffered sound signals of the predetermined length.

Preferably, the sound signal acquisition unit may comprise a microphone array composed of two or more microphones. In this case, the sample delay storage unit may comprise N registers with respect to each of channels of the sound signals. The correlation calculation unit may calculate correlations between a first channel and a second channel using the following equation:

$$R_{xy} = \frac{\sum_{n=0}^{M} x(n)y(n-k)}{\sqrt{\sum_{n=0}^{M} x(n)^2}\sqrt{\sum_{n=0}^{M} y(n-k)^2}}$$

where $R_{xy}$ is a correlation between sound signals input through the first and second channels, x(n) and y(n) are sample addresses of the first and second channels, respectively, M is any natural number, and k is a natural number smaller than M and is a sample delay value.

Preferably, the correlation calculation unit may comprise a plurality of correlation calculators for calculating a sum of products of values stored in respective cells of registers corresponding to the first channel and a value stored in an arbitrary cell of registers corresponding to the second channel.

Preferably, the sound source direction calculation unit may check a largest sample delay value from among correlations between the first and second channels, and calculate delay times of the sound signals based on the largest sample delay value.

In accordance with another aspect of the present invention, there is provided a method of localizing a sound source in real time, comprising the steps of acquiring sound signals through two or more channels; storing a plurality of pieces of data, sampled from the sound signals acquired through the respective channels, for a predetermined period of time; calculating correlations between the channels from the plurality of pieces of sampled data which are delayed and stored; and calculating an azimuth angle of the sound source using both the correlations between the channels and location relationships of a sound signal acquisition unit.

Preferably, the method may further comprise the steps of buffering acquired sound signals of a predetermined length after the sound signals have been acquired; and determining whether the buffered sound signals of the predetermined length are valid sound signals.

Preferably, the step of determining whether the buffered signals are valid sound signals may be performed such that, when energy of the sound signals of the predetermined length is equal to or greater than a reference value, the sound signals are determined to be valid sound signals. Further, the step of determining whether the buffered signals are valid sound signals may be performed to determine valid sound signals using a plurality of buffered sound signals of the predetermined length.

Preferably, the step of acquiring the sound signals may be performed using a microphone array composed of two or more microphones. Preferably, the step of calculating the correlations may be performed to calculate correlations between a first channel and a second channel using the following equation:

$$R_{xy} = \frac{\sum_{n=0}^{M} x(n)y(n-k)}{\sqrt{\sum_{n=0}^{M} x(n)^2}\sqrt{\sum_{n=0}^{M} y(n-k)^2}}$$

where $R_{xy}$ is a correlation between sound signals input through the first and second channels, x(n) and y(n) are sample addresses of the first and second channels, respectively, M is any natural number, and k is a natural number smaller than M and is a sample delay value.

Preferably, the step of calculating the correlations may be performed using a plurality of correlation calculators for calculating a sum of products of values stored in respective cells of registers corresponding to the first channel and a value stored in an arbitrary cell of registers corresponding to the second channel. Preferably, the step of calculating the sound source azimuth angle may be performed to check a largest sample delay value from among correlations between the first and second channels and calculate delay times of the sound signals based on the largest sample delay value.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Hereinafter, an apparatus and method for localizing a sound source in real time according to the present invention will be described in detail with reference to the attached drawings.

Figure 1:
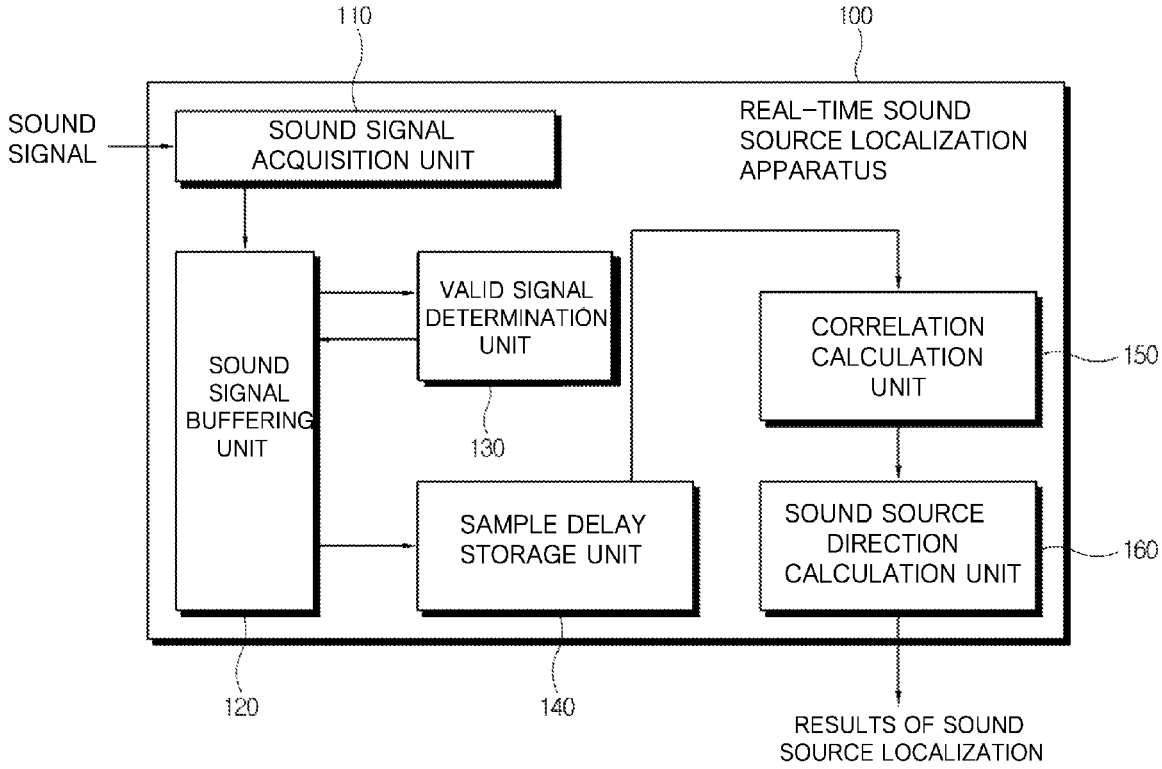
FIG. 1 is a diagram showing the construction of an apparatus for localizing a sound source in real time according to an embodiment of the present invention.

FIG. 1 is a diagram showing the construction of an apparatus for localizing a sound source in real time according to an embodiment of the present invention.

As shown in FIG. 1, an apparatus 100 for localizing a sound source in real time according to the present invention (hereinafter referred to as a 'real-time sound source localization apparatus') includes a sound signal acquisition unit 110, a sound signal buffering unit 120, a valid signal determination unit 130, a sample delay storage unit 140, a correlation calculation unit 150, a sound source direction calculation unit 160, etc.

The sound signal acquisition unit 110 acquires sound signals generated from outside of the sound source localization apparatus 100 according to the present invention. In particular, the sound signal acquisition unit 110 of the present invention preferably includes a microphone array composed of two or more microphones.

In this case, the respective microphones are spaced apart from one another by at least a predetermined distance, thus allowing the times at which sound signals are transferred between the sound source and the respective microphones to differ. Further, it is more preferable to configure the sound signal acquisition unit 110 so that signals acquired by the respective microphones are simultaneously sampled and sample signals, such as the samples $S_a(t)$, $S_b(t)$ and $S_c(t)$ of the respective microphones, can be simultaneously accessed at time t.

The sound signal buffering unit 120 functions to buffer the results of sampling of sound signals of a predetermined length before the sampling results are input to a subsequent component. Since the sound signals are sampled at relatively low speed due to the properties of the sense of human hearing, the acquired sound signals need to be buffered so as to guarantee higher processing speed.

At this time, since a sound signal currently being input must be continuously sampled and buffered even during the processing of previously input samples, the sound signal buffering unit 120 of the present invention is preferably implemented using dual port memory in which input and output are processed through different ports.

Further, samples which have been completely processed among the previously buffered samples do not need to be referred to any more. In order to improve the efficiency of memory, the sound signal buffering unit 120 for buffering the samples which have been completely processed is preferably implemented using a circular queue in which the samples of newly input sound signals can overwrite those sound samples which have been completely processed.

In this case, a set of samples to be processed is called a frame, and each frame must be processed every predetermined time (for example, at each sample period), and thus the sound signal buffering unit 120 applies a calculation start signal to the valid signal determination unit 130 whenever data of each frame is prepared.

The valid signal determination unit 130 is a component for determining whether the sound signals received from the sound signal acquisition unit 110 are valid signals.

The valid signal determination unit 130 of the present invention checks whether the energy of the received sound signals is equal to or greater than a reference value on the assumption that it can be considered that there was the activity of a specific sound only when the energy of the received sound signals is equal to or greater than a predetermined value. That is, a sound signal having energy less than a predetermined value is determined to be typical noise.

Here, the valid signal determination unit 130 preferably determines energy with respect to a plurality of samples rather than one sample. Therefore, the valid signal determination unit 130 calculates energy on the basis of the plurality of samples buffered in the sound signal buffering unit 120, determines that a relevant sound signal is valid if the calculated energy is equal to or greater than a predetermined value, and then performs a subsequent process. If the calculated energy is less than the predetermined value, the valid signal determination unit 130 waits for the sound signal buffering unit 120 to retransmit a calculation start signal.

The sample delay storage unit 140 stores data to process valid sound when input sound is valid. In order to localize sound, similarities between the respective channels of the sound signals input to the sound signal acquisition unit 110 must be measured. Here, a process for calculating the similarities between the respective channels is called a mutual correlation calculation.

In this case, when the calculation of mutual correlations is sequentially performed, calculation time increases in proportion to the total number of comparative samples. Therefore, the present invention provides a structure capable of simultaneously comparing one frame of one channel with a plurality of frames of another channel by storing a number of samples corresponding to the number of targets to be processed in registers. This structure will be described in detail with reference to FIG. 3.

The correlation calculation unit 150 calculates the similarity between one channel and another channel using the set of registers stored in the sample delay storage unit 140. Further, on the basis of the similarity, the direction of the sound source in which sound is generated is calculated. At this time, the calculation of the correlations between the sound signals obtained by the sound signal acquisition unit 110 may be performed by the following Equation (1).

$$R_{xy} = \frac{\sum_{n=0}^{3174} x(n)y(n-k)}{\sqrt{\sum_{n=0}^{3174} x(n)^2}\sqrt{\sum_{n=0}^{3174} y(n-k)^2}}, k = 0, \pm 1, \pm 2, \ldots, \pm 13 \quad (1)$$

The mutual correlations are ideally calculated on an infinite number of samples, but it is actually impossible to calculate correlations on an infinite number of samples in this way. Therefore, in the present invention, a range of sample delays for calculating correlations is defined as a range from −13 to +13.

The sound source direction calculation unit 160 obtains an azimuth angle of the sound source using both the correlations between the channels, obtained through the above procedure, and the location relationships of the microphones included in the sound signal acquisition unit. In particular, the sound source direction calculation unit 160 can measure input delay times between the sound signals of respective channels using the acquired correlations between the channels. The sound source direction calculation unit calculates the azimuth angle of the sound source using both the input delay times of the sound signals and the location relationships of the microphones.

Figure 2:
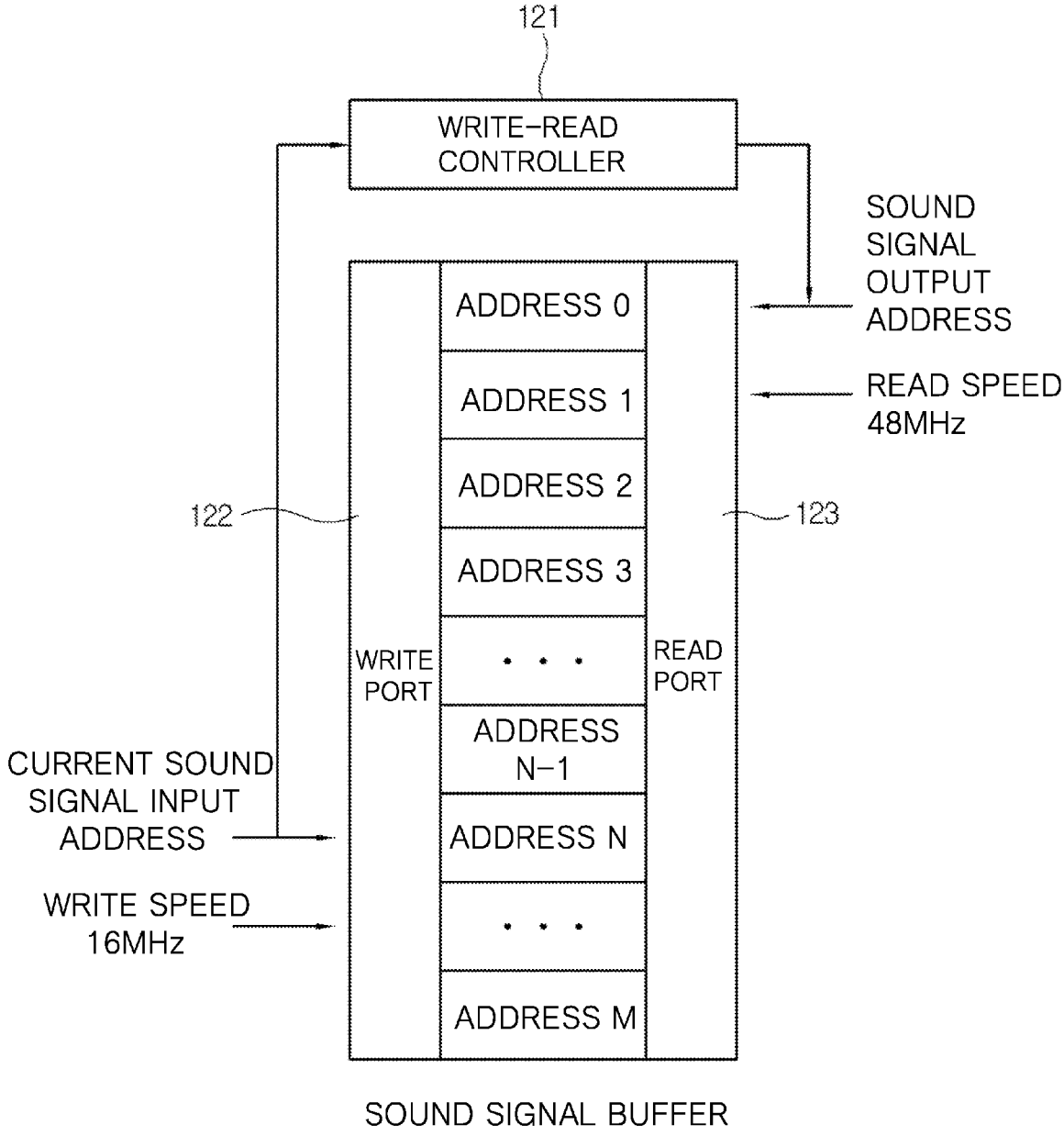
FIG. 2 is a diagram showing the detailed construction of the sound signal buffering unit of FIG. 1.

FIG. 2 is a diagram showing the detailed construction of the sound signal buffering unit of FIG. 1.

As shown in FIG. 2, the sound signal buffering unit 120 may include a write-read controller 121, a write port 122, a read port 123, a sound signal buffer 124, etc.

The sound signal buffer 124 of FIG. 2 is provided with M+1 sample storage spaces (cells), the addresses of which range from 0 to M.

The write-read controller 121 starts to read buffered samples every T cells. For example, when the current input address of a sound signal is N, the write-read controller 121 can recognize that N valid samples are stored. At this time, the write-read controller 121 may read samples having addresses ranging from N−T to N−1 and may transfer the read samples to a subsequent component.

When time elapses and the current input address of the sound signal is N+T, the write-read controller 121 may recognize that N new valid samples are stored, may read samples having addresses ranging from N to N+T−1, and may rapidly transfer the T samples to a subsequent component.

For this operation, it is preferable to set or implement the write speed and the read speed of the sound signal buffering unit 121 as different speeds. For example, in the present invention, the write speed required to write the currently input sound signal may be set as 16 KHz, and the read speed required to output a buffered sound signal may be set as 48 MHz.

This shows that, since it is possible to sample an input sound signal at relatively low speed due to the limitations of the sense of human hearing, the speed at which the input sound signal is written is relatively low. In contrast, since the sound source localization apparatus 100 according to the present invention must perform a plurality of calculations required to localize the sound source in real time, the speed required to read a buffered sound signal is set as a relatively high speed. Of course, those skilled in the art will easily appreciate that it is possible to set those speeds as values other than 16 KHz and 48 MHz.

Figure 3:
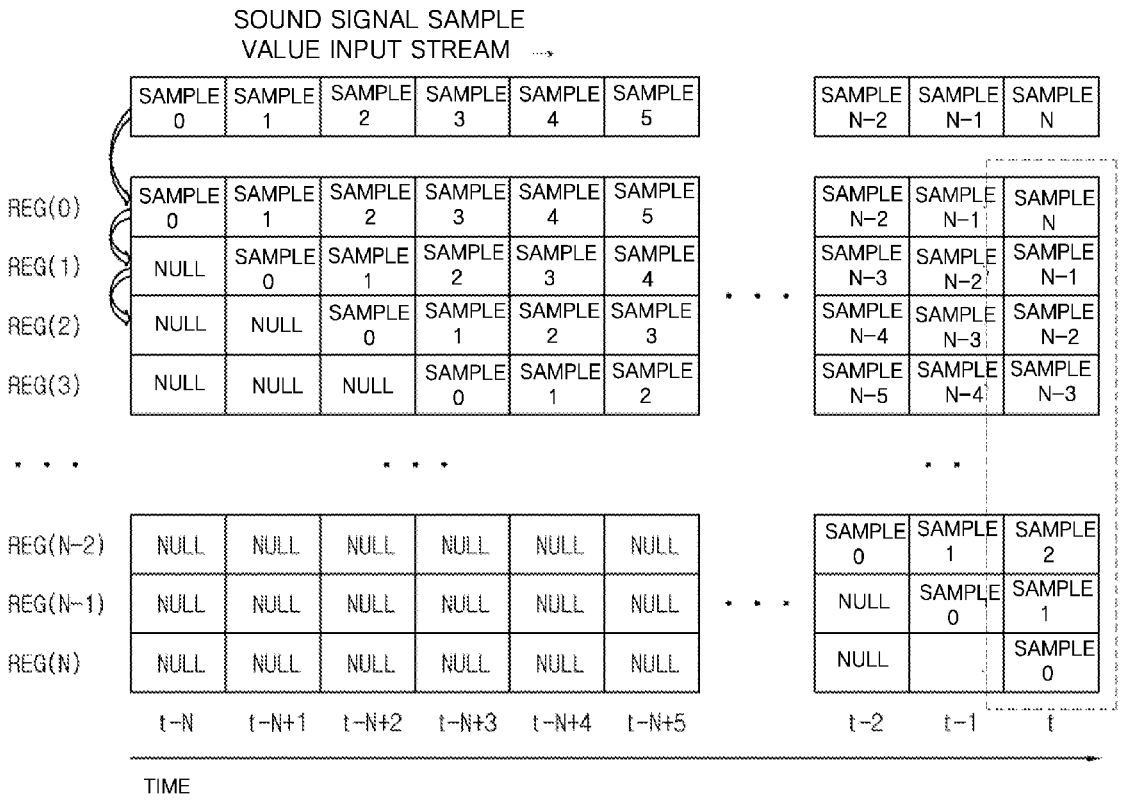
FIG. 3 is a diagram showing the detailed construction of the sample delay storage unit of FIG. 1.

FIG. 3 is a diagram showing the detailed construction of the sample delay storage unit of FIG. 1.

The sample delay storage unit 140 according to the embodiment of FIG. 3 is implemented using a set of N+1 registers. The sample delay storage unit of FIG. 3 may have cells ranging from REG(0) to REG(N).

In the embodiment of FIG. 3, before a time point of t-N seconds, the sample delay storage unit is in a null state in which no data is stored.

A sample input to the sample delay storage unit 140 is primarily stored in REG(0). For example, at time point t−N, a sample 0 is input to the sample delay storage unit 140. As described above, the input sample 0 is input to the REG(0) of the sample delay storage unit 140.

Thereafter, when one period has elapsed, the sample 0 stored in the REG(0) of the sample delay storage unit 140 is shifted to REG(1), and a sample 1 is newly stored in REG(0). In this way, the shift between the cells of respective registers is performed. Data stored in REG (N) which is the last row is dropped and discarded.

When such a process is repeated, and N periods have elapsed, a sample N is input to the sample delay storage unit 140. Accordingly, the sample N is stored in the REG(0) of the sample delay storage unit 140, and the shift is repeated, and thus the sample 0 is stored in the REG (N). Thereafter, when one period has further elapsed, the sample 0 stored in the REG(N) is dropped, and a sample N+1 is input to and stored in the REG(0).

Figure 4:
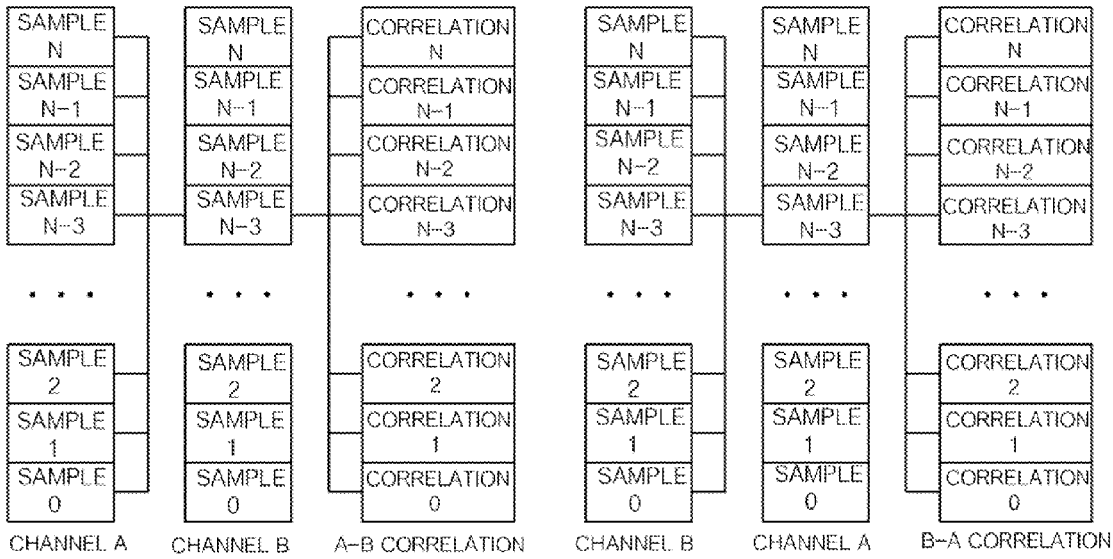
FIG. 4 is a diagram showing the detailed construction of the correlation calculation unit of FIG. 1.

FIG. 4 is a diagram showing the detailed construction of the correlation calculation unit of FIG. 1.

The correlation calculation unit 150 according to the embodiment of FIG. 4 has a structure for calculating the correlation between sound signals input through two channels when external sound signals are input through the two channels.

First, the two channels are respectively called channel A and channel B for convenience of description. First, the sample delay storage unit 140 according to the present invention may include a set of registers for storing samples with respect to each of channel A and channel B. The correlation calculation unit 150 receives sample values stored in the sample delay storage units 140 for channel A and channel B and performs the calculation of Equation (1).

The sample delay storage unit 140 for respective channels A and B is implemented as a set of registers capable of storing a total of N+1 samples having addresses ranging from 0 to N with respect to each of channels A and B. The construction and operation of this sample delay storage unit 140 are identical to those of FIG. 3.

The correlation calculation unit 150 may include an AB correlation calculation unit 151 and a BA correlation calculation unit 152.

The AB correlation calculation unit 151 may include a plurality of correlation calculators 153 for calculating the sum of the products of values stored in the respective cells of registers corresponding to channel A and a value stored in an arbitrary cell of registers corresponding to channel B.

Similarly, the BA correlation calculation unit 152 may include a plurality of correlation calculators 153 for calculating the sum of the products of values stored in the respective cells of registers corresponding to channel B and a value stored in an arbitrary cell of registers corresponding to channel A.

In FIG. 4, it can be seen that each of the AB correlation calculation unit 151 and the BA correlation calculation unit 152 includes N+1 correlation calculators 153 suitable for the storage capacity of the sample delay storage unit 140.

For example, in the AB correlation calculation unit 151, a correlation N−3 calculator is a calculator for obtaining correlations between sample N−3 of channel B and channel A. Similarly, in the BA correlation calculation unit 152, a correlation N−3 calculator is a calculator for obtaining correlations between sample N−3 of channel A and channel B.

Through the correlation calculation unit having the above construction, the present invention can calculate mutual correlations between respective channels in real time.

Figure 5:
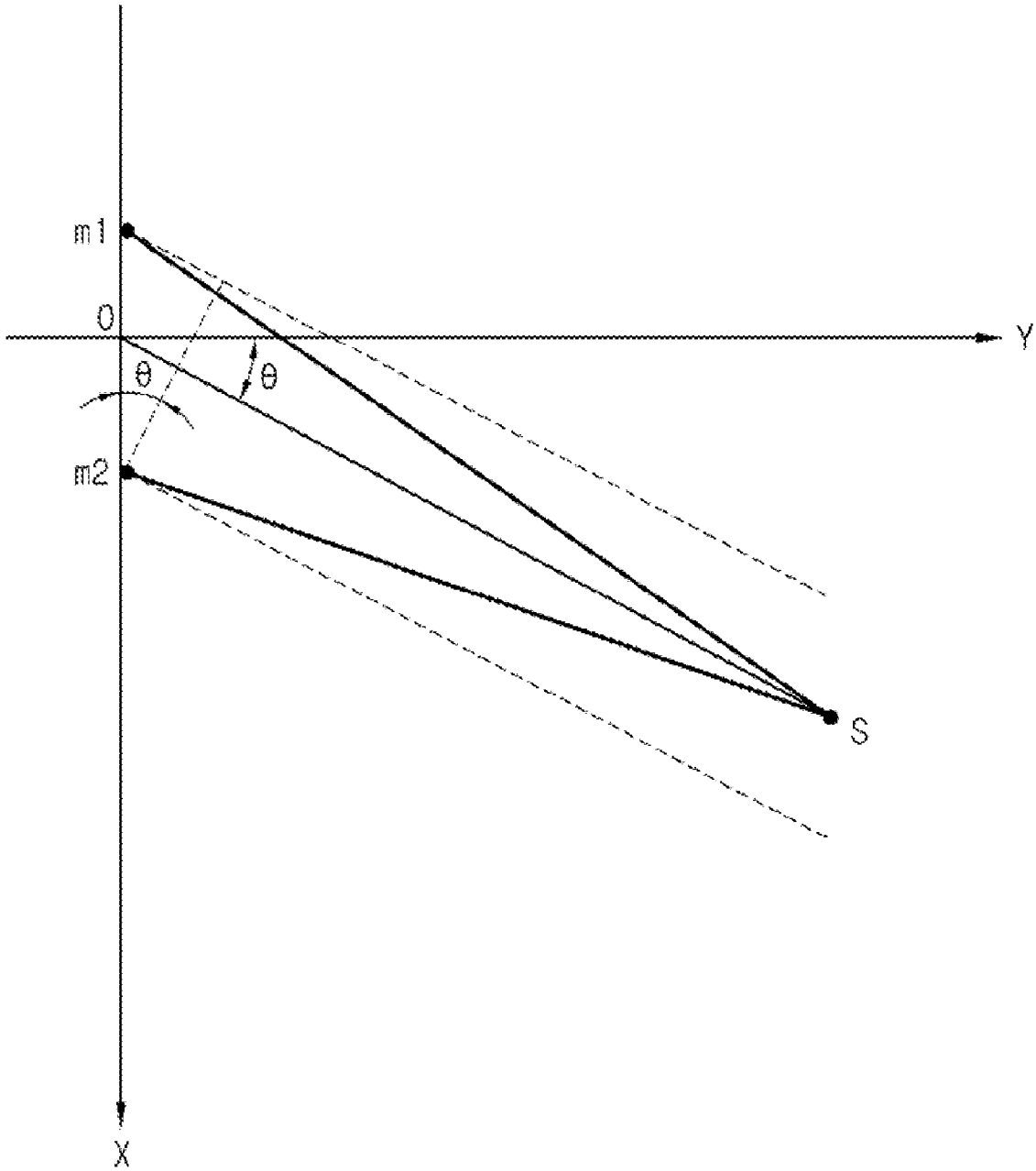
FIG. 5 is a diagram showing a sound source localization method performed by the sound source direction calculation unit of FIG. 1.

FIG. 5 is a diagram showing a sound source localization method performed by the sound source direction calculation unit of FIG. 1.

By way of the operation of the correlation calculation unit 150, the correlations between the sound signals input through channels A and B may be measured. Based on such correlations, the delay times of sound signals input through channels A and B can be obtained.

The sound source direction calculation unit 160 may localize the sound source using the delay times of the sound signals and information about the distances and angles of the microphones included in the sound signal acquisition unit 110.

As shown in FIG. 5, if it is assumed that sound speed is c, an acquired delay time is $\tau$, and the distance between microphones is d, the length of delay time will be $\tau \cdot c$. On the basis of such delay time information, the azimuth angle of the sound source may be obtained.

Figure 6:
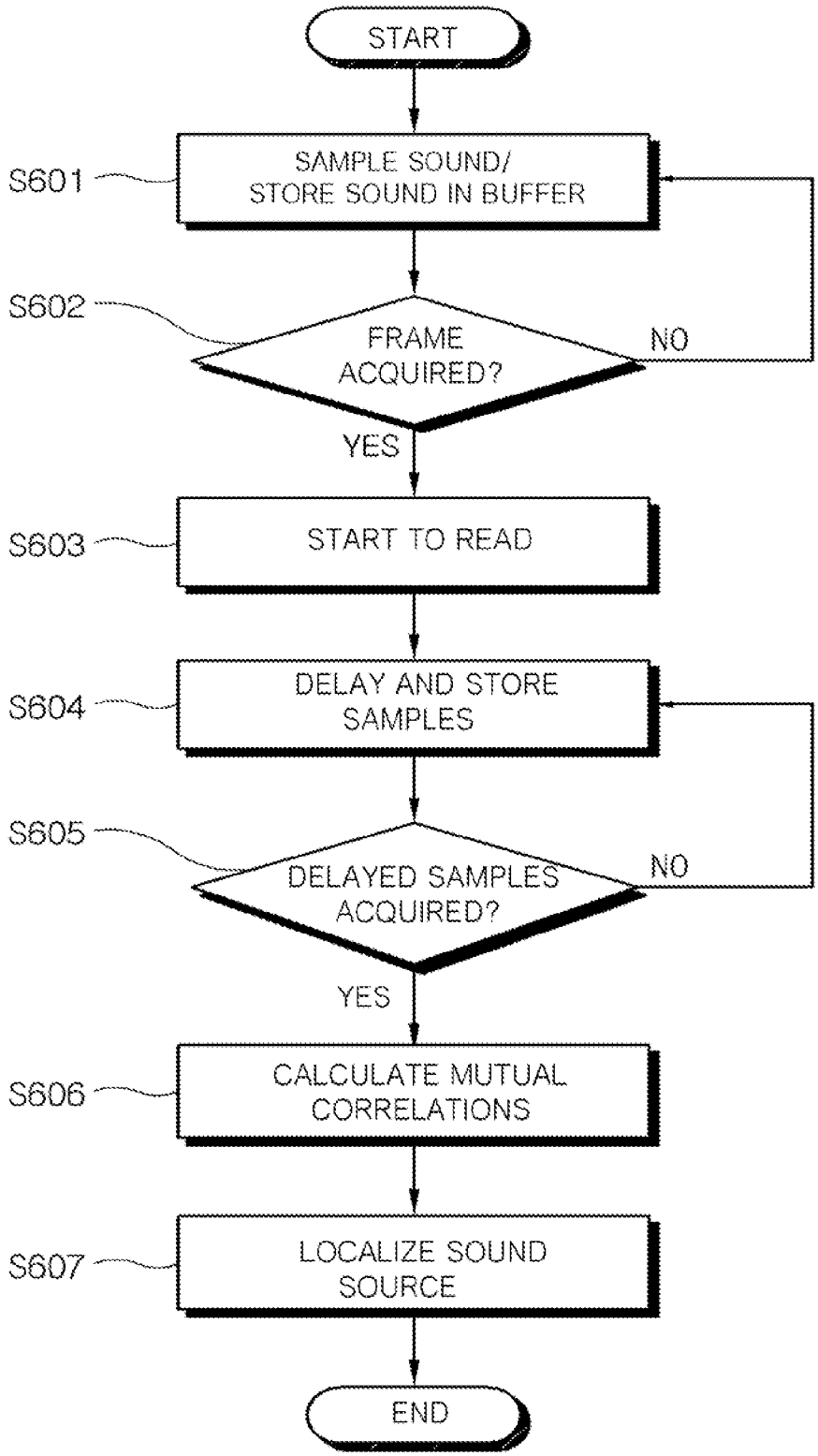
FIG. 6 is a diagram showing a method of localizing a sound source in real time according to another embodiment of the present invention.

FIG. 6 is a flowchart showing a method of localizing a sound source in real time according to anther embodiment of the present invention.

First, an apparatus for localizing a sound source in real time receives sound signals from a microphone array composed of two or more microphones. The received sound signals are stored in the sound signal buffering unit of the real-time sound source localization apparatus at step S601.

The real-time sound source localization apparatus checks samples stored in the sound signal buffering unit and determines whether a frame has been acquired at step S602. If it is determined that a number of samples sufficient to acquire a frame are stored, the real-time sound source localization apparatus starts to read these samples at step S603.

The samples read and output in this way are stored in the sample delay storage unit at step S604. The apparatus determines whether delayed samples have been acquired at step S605. If it is determined that the delayed samples have been successfully acquired (in the case of 'Yes' at step S605), the real-time sound source localization apparatus calculates the mutual correlations between channels using the delayed and stored samples, and thus calculates the delay times of the sound signals for respective channels at step S606. The real-time sound source localization apparatus performs calculation, which localizes the sound source, using the delay times corresponding to the locations of the channels at step S607. Each process of the method is almost the same as the function of each component of the real-time sound source localization system, and thus a detailed description thereof is omitted.

As described above, according to the real-time sound source localization apparatus and method of the present invention, parallel processing is performed by simultaneously accessing samples within a certain interval of acquired voice, thus realizing, with respect to given applications, performance superior to that of general-purpose computers suitable for sequential processing. The real-time sound source localization apparatus and method having these characteristics may be widely used in various application fields.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. Therefore, the scope of the present invention should be defined by the accompanying claims and equivalents thereof.

What is claimed is:

1. An apparatus for localizing a sound source in real time, comprising:

a sound signal acquisition unit for acquiring sound signals through two or more channels;

a sample delay storage unit for storing a plurality of pieces of data, sampled from the sound signals acquired through respective channels, for a predetermined period of time;

a correlation calculation unit for calculating correlations between the channels from the plurality of pieces of sampled data stored in the sample delay storage unit; and a sound source direction calculation unit for calculating an azimuth angle of the sound source using both the correlations between the channels and location relationships of the sound signal acquisition unit, a sound signal buffering unit for buffering acquired sound signals of a predetermined length; and a valid signal determination unit for determining whether the sound signals of the predetermined length buffered in the sound signal buffering unit are valid sound signals, wherein the sample delay storage unit comprises N registers with respect to each of channels of the sound signals, wherein the correlation calculation unit calculates correlations between a first channel and a second channel using the following equation:

$$R_{xy} = \frac{\sum_{n=0}^{M} x(n)y(n-k)}{\sqrt{\sum_{n=0}^{M} x(n)^2}\sqrt{\sum_{n=0}^{M} y(n-k)^2}}$$

where $R_{xy}$ is a correlation between sound signals input through the first and second channels, x(n) and y(n) are sample addresses of the first and second channels, respectively, M is any natural number, and k is a natural number smaller than M and is a sample delay value, wherein the correlation calculation unit comprises a plurality of correlation calculators for calculating a sum of products of values stored in respective cells of registers corresponding to the first channel and a value stored in an arbitrary cell of registers corresponding to the second channel.

2. The apparatus according to claim 1, wherein the sound signal buffering unit comprises a dual port structure in which input and output are processed through different ports.

3. The apparatus according to claim 1, wherein the sound signal buffering unit is implemented as a structure of a circular queue.

4. The apparatus according to claim 3, wherein the valid signal determination unit determines that the sound signals of the predetermined length are valid sound signals when energy of the sound signals is equal to or greater than a reference value.

5. The apparatus according to claim 4, wherein the valid signal determination unit determines valid sound signals using a plurality of buffered sound signals of the predetermined length.

6. The apparatus according to claim 1, wherein the sound signal acquisition unit comprises a microphone array composed of two or more microphones.

7. The apparatus according to claim 1, wherein the sound source direction calculation unit checks a largest sample delay value from among correlations between the first and second channels, and calculates delay times of the sound signals based on the largest sample delay value.

8. A method of localizing a sound source in real time, comprising the steps of:

acquiring sound signals through two or more channels;

storing a plurality of pieces of data, sampled from the sound signals acquired through the respective channels, for a predetermined period of time;

calculating correlations between the channels from the plurality of pieces of sampled data which are delayed and stored; and calculating an azimuth angle of the sound source using both the correlations between the channels and location relationships of a sound signal acquisition unit, wherein the step of acquiring the sound signals is performed using a microphone array composed of two or more microphones, wherein the step of calculating the correlations is performed to calculate correlations between a first channel and a second channel using the following equation:

$$R_{xy} = \frac{\sum_{n=0}^{M} x(n)y(n-k)}{\sqrt{\sum_{n=0}^{M} x(n)^2}\sqrt{\sum_{n=0}^{M} y(n-k)^2}}$$

where $R_{xy}$ is a correlation between sound signals input through the first and second channels, x(n) and y(n) are sample addresses of the first and second channels, respectively, M is any natural number, and k is a natural number smaller than M and is a sample delay value, wherein the step of calculating the correlations is performed using a plurality of correlation calculators for calculating a sum of products of values stored in respective cells of registers corresponding to the first channel and a value stored in an arbitrary cell of registers corresponding to the second channel.

9. The method according to claim 8, further comprising the steps of:

buffering acquired sound signals of a predetermined length after the sound signals have been acquired; and determining whether the buffered sound signals of the predetermined length are valid sound signals.

10. The method according to claim 9, wherein the step of determining whether the buffered signals are valid sound signals is performed such that, when energy of the sound signals of the predetermined length is equal to or greater than a reference value, the sound signals are determined to be valid sound signals.

11. The method according to claim 10, wherein the step of determining whether the buffered signals are valid sound signals is performed to determine valid sound signals using a plurality of buffered sound signals of the predetermined length.

12. The method according to claim 8, wherein the step of calculating the sound source azimuth angle is performed to check a largest sample delay value from among correlations between the first and second channels and calculate delay times of the sound signals based on the largest sample delay value.

* * * * *